US005605289A

United States Patent [19]

Maley et al.

[11] Patent Number: 5,605,289

[45] Date of Patent: Feb. 25, 1997

[54] FUEL INJECTOR WITH SPRING-BIASED CONTROL VALVE

[75] Inventors: Dale C. Maley, Fairbury; Steven B. Coleman, Peoria; Darwin Carrell, Edwards, all of Ill.; Doug Kinnear, Clifton Springs, N.Y.

[73] Assignees: Caterpillar Inc., Peoria, Ill.; G. W. Lisk Company, Inc., Clifton Springs, N.Y.

[21] Appl. No.: 348,567

[22] Filed: Dec. 2, 1994

[51] Int. Cl.[6] ..... B05B 1/30; F02M 51/00

[52] U.S. Cl. ..... 239/585.1; 251/129.02; 251/129.16

[58] Field of Search ..... 239/533.3, 533.4, 239/533.5, 533.9, 584, 585.1, 585.3; 251/129.02, 129.16, 129.18

[56] References Cited

U.S. PATENT DOCUMENTS

| | | | |
|---|---|---|---|
| 2,144,862 | 1/1939 | Truxell, Jr. | 299/107.2 |
| 2,421,329 | 5/1947 | Hoffer | 210/166 |
| 2,434,586 | 1/1948 | Reynolds | 31/58 |
| 2,512,557 | 6/1950 | Weldy | 299/107.6 |
| 2,535,937 | 12/1950 | Bozec et al. | 299/107.6 |
| 2,552,445 | 5/1951 | Nielsen | 299/131 |
| 2,597,952 | 5/1952 | Rosenlund | 137/139 |
| 2,621,011 | 12/1952 | Smith | 251/27 |
| 2,672,827 | 3/1954 | McGowen, Jr. | 103/232 |
| 2,727,498 | 12/1955 | Reiners | 123/32 |
| 2,749,181 | 6/1956 | Maxwell et al. | 299/107.6 |
| 2,916,048 | 12/1959 | Gunkel | 137/544 |
| 3,035,780 | 5/1962 | Peras | 239/453 |
| 3,057,560 | 10/1962 | Campbell | 239/464 |
| 3,071,714 | 1/1963 | Hadekel | 317/172 |
| 3,175,771 | 3/1965 | Bréting | 239/533 |
| 3,410,519 | 11/1968 | Evans | 251/141 |
| 3,532,121 | 10/1970 | Sturman et al. | 137/625.4 |
| 3,570,806 | 3/1971 | Sturman et al. | 251/65 |
| 3,570,807 | 3/1971 | Sturman et al. | 251/65 |
| 3,570,833 | 3/1971 | Sturman et al. | 267/161 |
| 3,585,547 | 6/1971 | Sturman | 335/227 |
| 3,604,959 | 9/1971 | Sturman et al. | 310/12 |
| 3,675,853 | 7/1972 | Lapera | 239/464 |

(List continued on next page.)

FOREIGN PATENT DOCUMENTS

| | | |
|---|---|---|
| 0425236A1 | 5/1991 | European Pat. Off. . |
| 0246373B1 | 3/1992 | European Pat. Off. . |
| 981664 | 12/1982 | U.S.S.R. . |

OTHER PUBLICATIONS

Figs. A and B, 1 sheet.

Caterpillar Inc. drawing 100–8271, Sheet 1 of 2, dated Dec. 7, 1992.

Caterpillar Inc. drawing 100–8271, Sheet 2 of 2, dated Dec. 7, 1992.

*Primary Examiner*—Lesley D. Morris

*Attorney, Agent, or Firm*—Marshall, O'Toole, Gerstein, Murray & Borun

[57] ABSTRACT

A fuel injector assembly and a control valve for such an assembly which automatically compensate for changes in the emissions generated by the engine by changing the timing of fuel injection within the engine. The fuel injector assembly, which causes fuel to be injected during a fuel injection cycle having a start time and a stop time, includes a fuel injector nozzle, a fuel pump, and a fuel inlet associated with the fuel pump, which causes fuel to be periodically pumped from the fuel inlet through the fuel injector nozzle. A control valve, which is associated with the fuel pump and which controls the start time and the stop time of the fuel injection cycle, includes a valve body and a solenoid-actuated armature disposed in a recess in the valve body. The armature has a first side and an opposed second side and is reciprocable within the recess between a first position and a second position. A first spring is disposed on the first side of the armature to exert a first spring force on the armature in accordance with a first long-term spring characteristic, and a second spring is disposed on the second side of the armature to exert a second spring force on the armature in accordance with a second long-term spring characteristic different than the first long-term spring characteristic so that the start time of the fuel injection cycle changes over time.

16 Claims, 3 Drawing Sheets

U.S. PATENT DOCUMENTS

| | | | |
|---|---|---|---|
| 3,683,239 | 8/1972 | Sturman | 317/150 |
| 3,743,898 | 7/1973 | Sturman | 317/154 |
| 3,753,547 | 8/1973 | Topham | 251/120 |
| 3,814,376 | 6/1974 | Reinicke | 251/65 |
| 3,821,967 | 7/1974 | Sturman et al. | 137/624.15 |
| 3,835,829 | 9/1974 | Links | 123/139 E |
| 3,858,135 | 12/1974 | Gray | 335/266 |
| 3,989,066 | 11/1976 | Sturman et al. | 137/624.2 |
| 4,087,736 | 5/1978 | Mori et al. | 322/28 |
| 4,087,773 | 5/1978 | Jencks et al. | 335/243 |
| 4,107,546 | 8/1978 | Sturman et al. | 307/141 |
| 4,108,419 | 8/1978 | Sturman et al. | 251/30 |
| 4,114,647 | 9/1978 | Sturman et al. | 137/624.2 |
| 4,114,648 | 9/1978 | Nakajima et al. | 137/625.5 |
| 4,120,456 | 10/1978 | Kimura et al. | 239/464 |
| 4,152,676 | 5/1979 | Morgenthaler et al. | 333/24.1 |
| 4,189,816 | 2/1980 | Chalansonnet | 29/148.4 |
| 4,192,466 | 3/1980 | Tanasawa et al. | 239/464 |
| 4,231,525 | 11/1980 | Palma | 239/585 |
| 4,248,270 | 2/1981 | Ostrowski | 138/45 |
| 4,266,727 | 5/1981 | Happel et al. | 239/409 |
| 4,273,291 | 6/1981 | Müller | 239/533.12 |
| 4,275,693 | 6/1981 | Leckie | 123/447 |
| 4,308,891 | 1/1982 | Loup | 137/551 |
| 4,354,662 | 10/1982 | Thompson | 251/129 |
| 4,375,274 | 3/1983 | Thoma et al. | 239/117 |
| 4,392,612 | 7/1983 | Deckard et al. | 239/88 |
| 4,396,037 | 8/1983 | Wilcox | 137/625.65 |
| 4,409,638 | 10/1983 | Sturman et al. | 361/152 |
| 4,482,094 | 11/1984 | Knape | 239/88 |
| 4,501,290 | 2/1985 | Sturman et al. | 137/495 |
| 4,516,600 | 5/1985 | Sturman et al. | 137/495 |
| 4,518,147 | 5/1985 | Andresen et al. | 251/121 |
| 4,526,519 | 7/1985 | Mowbray et al. | 417/490 |
| 4,541,454 | 9/1985 | Sturman et al. | 137/505.41 |
| 4,558,844 | 12/1985 | Donahue, Jr. | 251/118 |
| 4,610,428 | 9/1986 | Fox | 251/129.16 |
| 4,653,455 | 3/1987 | Eblen et al. | 123/506 |
| 4,658,824 | 4/1987 | Scheibe | 123/472 |
| 4,702,212 | 10/1987 | Best et al. | 123/472 |
| 4,721,253 | 1/1988 | Noguchi et al. | 239/464 |
| 4,753,416 | 6/1988 | Inagaki et al. | 251/129.15 |
| 4,794,890 | 1/1989 | Richeson, Jr. | 123/90.11 |
| 4,811,221 | 3/1989 | Sturman et al. | 364/420 |
| 4,812,884 | 3/1989 | Mohler | 335/258 |
| 4,813,599 | 3/1989 | Greiner et al. | 239/456 |
| 4,831,989 | 5/1989 | Haines | 123/506 |
| 4,846,440 | 7/1989 | Carlson et al. | 251/129.17 |
| 4,875,499 | 10/1989 | Fox | 137/82 |
| 4,893,102 | 1/1990 | Bauer | 335/132 |
| 4,893,652 | 1/1990 | Nogle et al. | 137/596.17 |
| 4,928,887 | 5/1990 | Miettaux | 239/584 |
| 4,964,571 | 10/1990 | Taue et al. | 239/88 |
| 4,993,637 | 2/1991 | Kanesaka | 239/96 |
| 5,004,577 | 4/1991 | Ward | 264/112 |
| 5,042,445 | 8/1991 | Peters et al. | 123/446 |
| 5,049,971 | 9/1991 | Krumm | 357/55 |
| 5,050,543 | 9/1991 | Kawamura | 123/90.11 |
| 5,110,087 | 5/1992 | Studtmann et al. | 251/129.16 |
| 5,121,730 | 6/1992 | Ausman et al. | 123/467 |
| 5,131,624 | 7/1992 | Kreuter et al. | 251/129.18 |
| 5,161,779 | 11/1992 | Graner et al. | 251/129.16 |
| 5,188,336 | 2/1993 | Graner et al. | 251/129.16 |

FUEL INJECTOR WITH SPRING-BIASED CONTROL VALVE

TECHNICAL FIELD

The present invention relates generally to fuel injection systems and, more particularly to a spring-biased control valve adapted for a fuel injector.

BACKGROUND ART

In conventional fuel injection systems, the fuel injectors may be mechanically, hydraulically, or electrically actuated. In hydraulically-actuated systems, the pumping assembly which periodically causes fuel to be injected into the engine cylinders is hydraulically driven by pressurized actuating fluid which is selectively communicated to the pumping assembly by an electronically-controlled valve. One example of a hydraulically-actuated, electronically-controlled fuel injection system is disclosed in U.S. Pat. No. 5,121,730 to Ausman, et al.

In mechanically-actuated systems, the pumping assembly is mechanically coupled to a cam driven by the engine so that the pumping assembly is actuated in synchronism with the rotation of the cam. The precise timing and duration of injection is determined by an electronically-controlled valve associated with the pumping assembly. Typically, the electronically-controlled valve is a solenoid valve.

In an engine in which such a fuel injection system is incorporated, the emissions, such as particulate emissions and NOx emissions, generated by the engine may change over a relatively long period of time, such as a year or more, as the engine ages. Since there are relatively strict government standards which limit the amount of emissions the engine may generate, the fact that the emissions may change over long periods of time is a disadvantage.

DISCLOSURE OF THE INVENTION

The invention is directed to a fuel injector assembly and a control valve for such an assembly which automatically compensate for changes in the emissions generated by the engine by changing the timing of fuel injection within the engine. As a result, over long periods of time, the emissions generated by the engine do not substantially change, or they change to an inconsequential degree.

In accordance with the invention, a fuel injector assembly for causing fuel to be injected during a fuel injection cycle having a start time and a stop time is provided with a fuel injector nozzle, a fuel pump, and a fuel inlet associated with the fuel pump. The fuel pump causes fuel to be periodically pumped from the fuel inlet through the fuel injector nozzle.

The fuel injector assembly is provided with a control valve associated with the fuel pump for controlling the start time and the stop time of the fuel injection cycle. The control valve includes a valve body and an armature disposed in a recess in the valve body. The armature has a first side and an opposed second side and is reciprocable within the recess between a first position and a second position. A first spring is disposed on the first side of the armature to exert a first spring force on the armature in accordance with a first long-term spring characteristic, and a second spring is disposed on the second side of the armature to exert a second spring force on the armature in accordance with a second long-term spring characteristic different than the first long-term spring characteristic so that the start time of the fuel injection cycle changes over time.

The control valve also includes an electromagnetic device disposed adjacent one side of the armature which causes the armature to occupy one of the first and second positions when the electromagnetic device is electrically energized and a valve element rigidly connected to the armature and disposed for reciprocating movement within the valve body. The valve element allows fluid flow through the control valve when the armature is in the first position and prevents fluid flow through the control valve when the armature is in the second position.

BEST MODE FOR CARRYING OUT THE INVENTION

Figure 1:
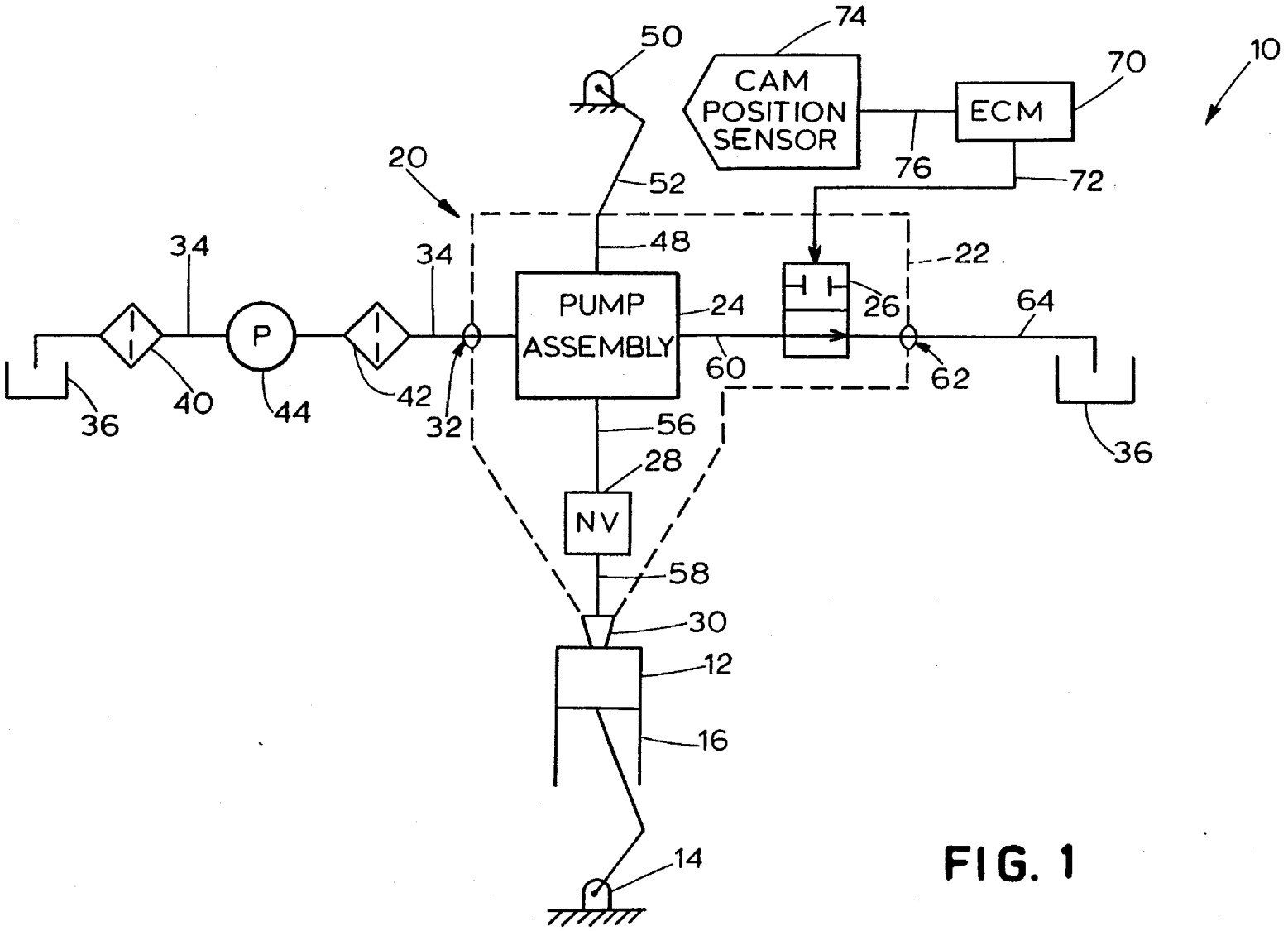
FIG. 1 is a schematic diagram illustrating a mechanically-actuated electronically-controlled unit injector fuel system having a fuel injector with an electronic control valve.

One embodiment of a mechanically-actuated electronically-controlled unit injector ("MEUI") fuel system 10 is illustrated in FIG. 1. The fuel injection system 10 is adapted for a diesel-cycle, internal combustion engine having a number of engine pistons 12, one of which is shown attached to an engine crank shaft 14 and disposed for reciprocating movement in an engine cylinder 16.

Fuel is injected into the cylinder 16 by a fuel injector 20 having a fuel injector body schematically designated by dotted lines 22, a pump assembly 24, a control valve 26, a nozzle valve 28, and a nozzle 30. Pressurized fuel is supplied to the pump assembly 24 through a fuel inlet 32 fluidly connected to a fuel passageway or line 34, which is in turn fluidly connected to a fuel tank or reservoir 36. A pair of fuel filters 40, 42 are provided in the fuel line 34, and the fuel is pressurized to a relatively low pressure, such as 410 kPa (60 psi) by a transfer pump 44.

The fuel supplied to the pump assembly 24 via the fuel passageway 34 is, within the pump assembly 24, periodically pressurized from the relatively low pressure to a relatively high injection pressure, such as 210,000 kPa (30,000 psi), by a plunger 48 which is mechanically connected to an engine cam 50 via a rocker arm 52. The nozzle valve 28 is fluidly connected to the pump assembly 24 via a fuel conduit 56 and is fluidly connected to the nozzle 30 via a fuel passageway 58. The nozzle valve 28 operates as a check valve which opens when the fuel provided to it by the pump assembly 24 reaches a relatively high threshold injection pressure, such as 34,200 kPa (5,000 psi), and closes when the fuel pressure falls below the threshold pressure.

The fuel pressurization provided by the pump assembly 24 is controlled by the control valve 26, which is fluidly connected to the pump assembly 24 via a fuel line 60. When the control valve 26 is in its open position, as shown in FIG. 1, fuel may exit the pump assembly 24 via the-fuel line 60, through a fuel outlet 62 formed in the fuel injector body 22, and through a fuel passageway or line 64 which drains into the fuel reservoir 36, thus preventing the fuel within the pump assembly 24 from being pressurized to the injection pressure by the plunger 48. When the control valve 26 is closed, fuel may not exit the pump assembly 24 via the fuel line 60, and thus the fuel may be pressurized by the plunger 48.

The opening and closing of the control valve 26 is controlled by an engine control module ("ECM") 70 connected to it by an electrical line 72. The engine control module 70 is connected to a cam-position sensor 74 which senses the position of the cam 50 and generates a cam-position signal on a line 76 connected to the engine control module 70. In response to the cam-position signal, the engine control module 70 generates electrical power on the line 72 to periodically open and close the control valve 26, which is solenoid-actuated, to cause fuel to be periodically injected into the cylinder 16.

The operation of the fuel injection system 10 is described below in connection with one injection cycle. To begin fuel injection, the control valve 26 is moved from its open position, as shown in FIG. 1, to its closed position, which prevents fuel from exiting the pump assembly 24 via the fuel line 60. After the control valve 26 is closed, the rocker arm 52 drives the plunger 48 downwards, which increases the pressure of the fuel within the pump assembly 24 and the pressure of the fuel provided to the nozzle valve 28. When the fuel pressure in the nozzle valve 28 reaches the relatively high threshold injection pressure, the nozzle valve 28 opens and fuel is injected through the nozzle 30 into the cylinder 16.

When fuel injection is to be ended, the control valve 26 is moved from its closed position to its open position. As a result, pressurized fuel exits the pump assembly 24 through the fuel passageways 60, 62, causing the fuel pressure in the pump assembly 24 and in the nozzle valve 28 to decrease. When the fuel pressure in the nozzle valve 28 falls below the threshold injection pressure, the nozzle valve 28 closes, thus terminating the injection of fuel into the cylinder 16.

Figure 2:
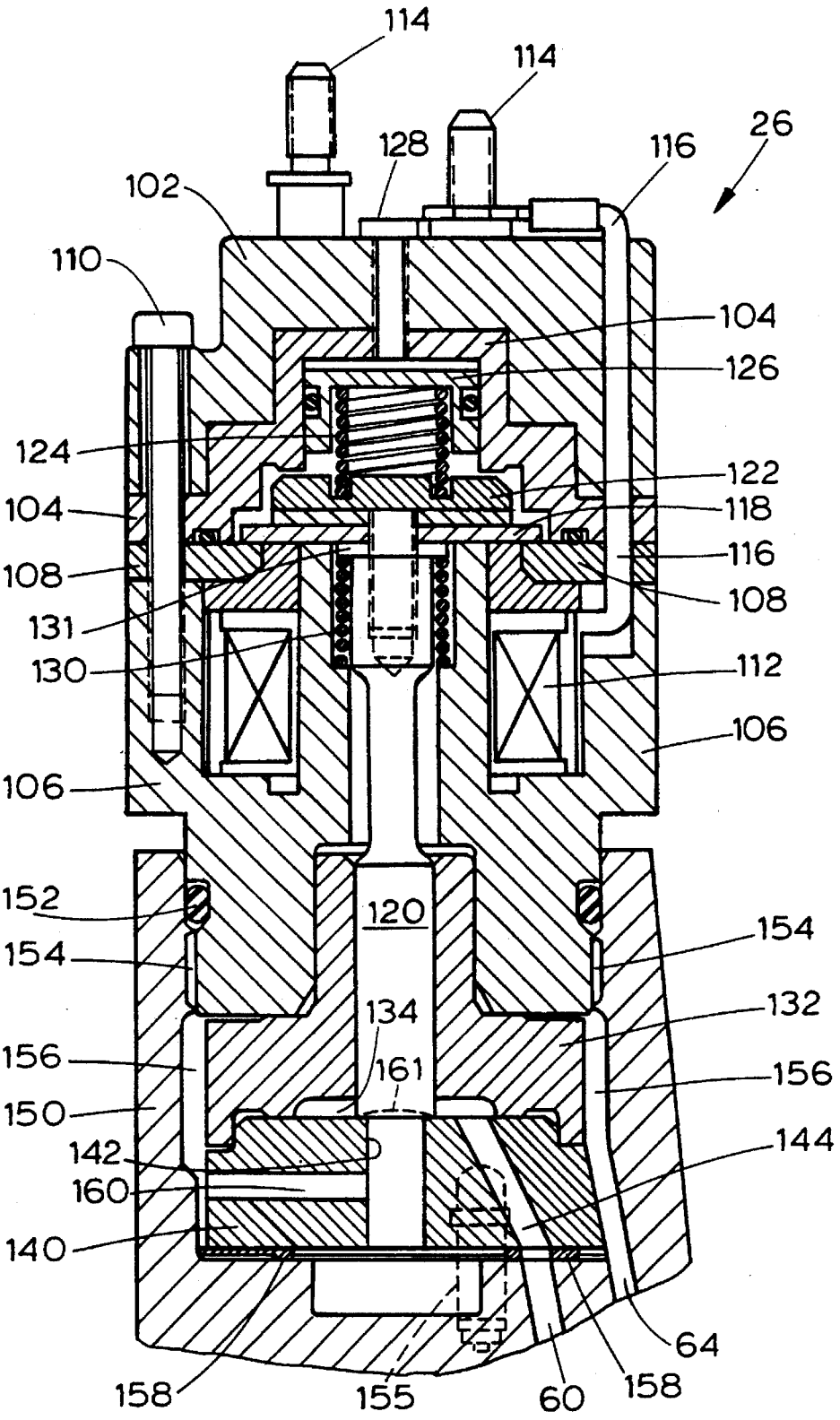
FIG. 2 is a partial cross-sectional view of a solenoid actuator for the electronic control valve shown schematically in FIG. 1.

A cross-section of an embodiment of the control valve 26 schematically shown in FIG. 1 is illustrated in FIG. 2. The control valve 26 has a valve body composed of a number of valve body portions including a generally cylindrical upper valve body portion 102, an interior valve body portion 104, and a mid-body portion 106. A spacer element 108 is disposed between the interior body portion 104 and the mid-body portion 106. The valve body portions 102, 104, 106 and spacer element 108 may be fixed together by any conventional means, such as by one or more bolts 110. An electrically energizable electromagnetic device in the form of a wire coil 112 is disposed within an annular recess formed in the mid-body portion 106. The wire coil 112 may be selectively energized via a pair of electrical connectors 114 connected to the wire coil via one or more conductive members 116.

A generally flat, cylindrical armature 118 is disposed in a space formed in the interior of the valve body. The armature 118 is fixed between the upper end of a generally cylindrical valve element 120 and a lower spring-seat member 122. The bottom end of a spring 124 is disposed in an annular groove formed in the upper surface of the lower seat member 122, and the top end of the spring 124 is disposed in an interior cylindrical cavity of an upper spring-seat member 126.

A trim screw 128 is threaded into the valve body portions 102, 104 so that its lower tip makes contact with the upper surface of the upper spring seat member 126. The vertical position of the upper seat member 126 within the valve body portion 104, and thus the amount of force the spring 124 exerts on the armature 118, can be adjusted by rotation of the trim screw 128. A second spring 130 is disposed between a washer 131 fixed to the underside of the armature 118 and an annular edge formed in the valve body portion 106.

The valve element 120, which is fixed to the armature 118, is disposed for vertical reciprocating movement within a central bore formed in a guide barrel 132. The guide barrel 132 has a flat circular recess 134 formed in its bottom. A flow guide member 140 is disposed directly below the guide barrel 132 and has a vertical bore 142 disposed coaxially with the central bore formed in the guide barrel 132. The flow guide 140 has a second, angled bore 144 that is fluidly connected to the flat circular recess 134 formed in the guide barrel 132.

A housing member 150 surrounds the guide barrel 132 and the flow guide 140. The housing member 150, the flow guide 140, the guide barrel 132 and the body portion 102, 106 together constitute the remainder of the valve body. An O-ring 152 is disposed between the mid-body portion 106 and the housing member 150, and the housing member 150 is threadably connected to the mid-body portion 106 at threads 154. An alignment pin or screw 155 may be provided to prevent misalignment of the flow guide 140 with respect to the housing portion 150.

An annular space 156 that acts as a flow passageway is disposed between the interior wall of the housing member 150 and the exterior walls of the guide member 132 and the flow guide 140. The flow guide 140 has a horizontal bore 160 that fluidly connects the vertical bore 142 with the annular flow passageway 156. A fluid-sealing steel ring 158 is disposed between the flow guide 140 and the housing 150.

The housing 150 has the fuel inlet line or bore 60 formed therein (which is shown schematically in FIG. 1) which is fluidly connected to the angled bore 144 and the fuel outlet passageway or bore 64 (shown schematically in FIG. 1) fluidly coupled to the annular flow passageway 156.

The bottom end of the valve element 120 has a slight concave recess 161 in its central portion which results in the formation of a relatively sharp annular ridge or "knife-edge" about the bottom end of the valve element 120. The annular ridge selectively makes contact with a flat valve seat consisting of the flat upper surface of the flow guide 140 about the periphery of the vertical bore 142.

Each of the springs 124, 130 exerts a spring force on the armature 118. The net total of those two spring forces is an upward spring force which, in the absence of energization of the coil 11.2, causes the armature 118 to occupy its upper position so that the control valve 26 is open.

When the valve element 120 is positioned (as shown in FIG. 2) so that its end makes sealing contact with the valve seat, flow from the fuel line 60 to the fuel passageway 64 is blocked, and fuel injection may take place. When the valve element 120 is in this lower position, the lower surface of the armature 118 is spaced slightly (such as several thousandths of an inch) from the upper surface of the spacer element 108. The valve element 120 occupies this lower position when the coil 112 is energized to overcome the net upward force on the armature 118 generated by the springs 124, 130.

When the valve element 120 is reciprocated upwards from its lower position shown in FIG. 2 so that its end is spaced from the valve seat, fuel may flow from the fuel line 60 along a flow conduit comprising the angled bore 144, the circular recess 134, the vertical bore 142, the horizontal bore 160, the annular recess 156 and to the fuel passageway 64.

The valve element 120 occupies this upper position when the coil 112 is deenergized.

The material of each of the springs 124, 130 is specially selected so that each spring 124, 130 exhibits a different long-term spring characteristic. As used herein, "long-term spring characteristic" means the spring force exerted by a spring over its operating life, which is a relatively long period of time defined to be at least one month.

Figure 3:
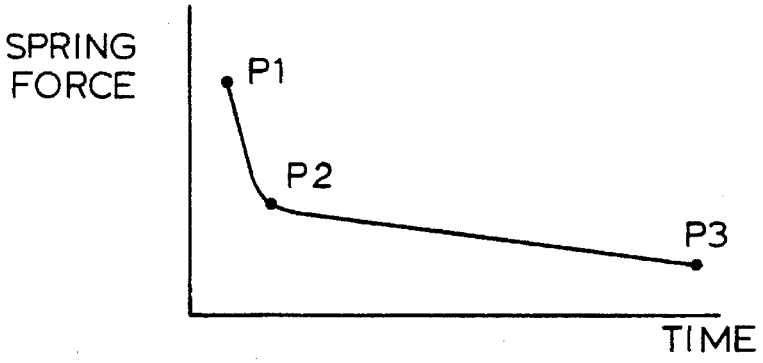
FIG. 3 illustrates one example of a spring characteristic.

One example of a spring characteristic is illustrated in FIG. 3. As illustrated in FIG. 3, at a point P1 on the spring characteristic (when the spring is new), the spring generates an initial spring force. The spring force generated by the spring decreases with time relatively quickly (within the first few hours of the operating life of the spring) to a point P2, where the spring force is lower, and then decreases very gradually to a point P3 towards the end of its operating life (measured in terms of years), where the force generated by the spring is lower still. The spring characteristic illustrated in FIG. 3 is intended to be exemplary, and there are other spring characteristics. For example, it is possible to manufacture a spring having a spring force which increases over time, instead of decreasing.

Figure 4:
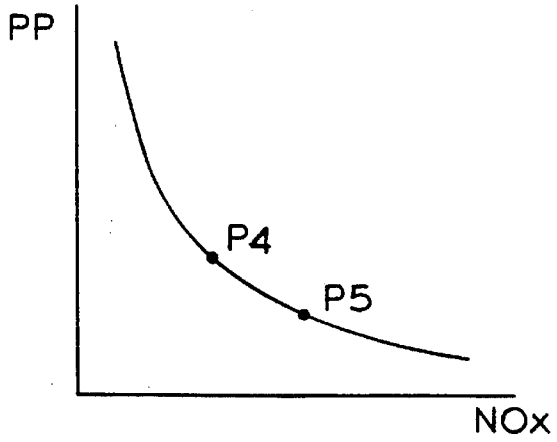
FIG. 4 is an emissions characteristic curve illustrating the relationship between particulate and NOx emissions generated by an engine.

Referring to FIG. 4, a given type of engine has an emissions characteristic curve in which two emissions, particulate (PP) emissions and NOx emissions (such as $NO_2$, $NO_3$, etc.), have an inverse relationship to each other. That is, as the amount of PP emissions generated by the engine increases, the amount of NOx emissions decreases. Each given type or design of an engine has its own unique emission characteristic of the type shown in FIG. 4, and over the life of an engine of that type, the emissions generated by the engine will be specified by one point on the curve. The emissions characteristic curve of a given type of engine may be empirically determined by operating that engine over its operating life and periodically measuring the amounts of emissions it generates at various points in time during that operating life.

For example, when an engine is new, it may have an operating point P4 on the emissions curve, in which case the amounts of particulate and NOx emissions specified by that point are generated by the engine. As the engine ages, the emissions operating point may gradually change to a new point P5 (for reasons beyond the scope of this description).

As environmental regulation becomes more stringent, it may be desirable (or necessary) to have an engine operate at a specific emissions operating point, or within a range of emissions operating points, so that the regulatory limits for the emissions are satisfied. Thus, for example, it may be desirable to operate at, or close to, point P4 on the curve shown in FIG. 4. If point P4 were the optimal emissions operating point, the change or drift in the operating point to point P5 would be undesirable.

The inventors have recognized that the emissions operating point may be changed by changing the timing of fuel injection within the engine. Thus, for example, the emissions operating point of the engine may be changed from point P5 to point P4 by changing the time at which fuel injection begins, and in particular, by causing the start time of fuel injection to begin later than it otherwise would.

The inventors have also recognized that the time at which fuel injection begins could be changed by causing the net upward force on the armature 118 to change. It should be understood that, as the net upward spring force on the armature 118 increases, the time at which fuel injection begins occurs later since a larger net spring force must be overcome to move the armature 18 downwards to close the valve 26 to allow fuel injection to begin.

Thus, to compensate for undesirable drift in the emissions operating point, each of the springs 124, 130 is selected to have a different long-term spring characteristic so that the net upward force on the armature 118 gradually changes over the operating life of the engine to compensate for any drift of the emissions operating point. As a result, an engine may be designed so that the emissions operating point does not substantially change, or so that it stays within a predetermined operating range.

Figure 5:
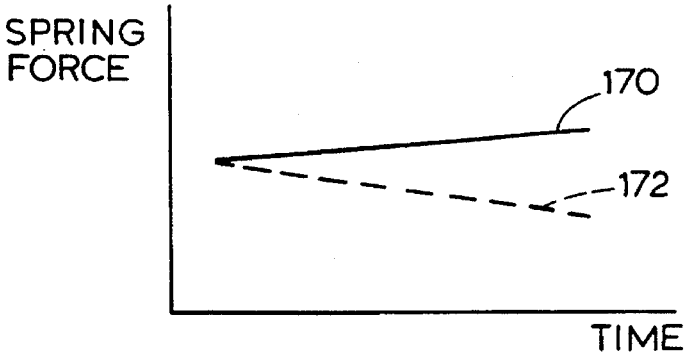
FIG. 5 illustrates a pair of long-term spring characteristics in accordance with the invention.

FIG. 5 illustrates an exemplary pair of long-term spring characteristics of the springs 124, 130 in accordance with the invention (any initial, relatively rapid changes in the spring characteristics early in the operating life of the springs 124, 130 are not illustrated). Referring to FIG. 5, a first long-term spring characteristic, which rises slightly over time, is represented by a line 170, and a second long-term spring characteristic, which gradually decreases with time, is shown by dotted line 172.

If the upper spring 124 had the spring characteristic 172 and the lower spring 130 had the spring characteristic 170, the net upward force on the armature 118 would gradually increase over time, and consequently the start time at which fuel injection began would gradually become later than it otherwise would be. As a result, the emissions operating point of the engine, which would otherwise gradually move over a long period of time in the direction from point P4 to point P5 on the curve of FIG. 4, would not substantially change, or would remain within a predetermined operating point range.

If the upper spring 124 had the spring characteristic 170 and the lower spring 130 had the spring characteristic 172, the net upward force on the armature 118 would gradually decrease over time, and consequently the start time at which fuel injection began would gradually become earlier than it otherwise would be. As a result, the emissions operating point of the engine, which would otherwise gradually move over a long period of time in the direction from point P5 to point P4 on the curve of FIG. 4, would not substantially change, or would remain within a predetermined operating point range. Other combinations of various long-term spring characteristics for the springs 124, 130 could be used to achieve the desired results. The only necessity is that the long-term spring characteristics for the two springs 124, 130 be different from each other.

One example of a spring material that could be used to form a spring with a substantially constant long-term spring characteristic is chrome silicon that is heat-set by completely compressing the spring and subjecting the spring to a temperature of 204° C. (400° F.) for an hour while the spring is fully compressed and which is used at an operating stress of 210,000 kPa (30,000 psi).

A spring material that could. be used to form a spring with a decreasing long-term spring characteristic like the one represented by the dotted line 172 in FIG. 5 is non-heat-set, low carbon steel and which is used at an operating stress of 535,000 kPa (75,000 psi).

A spring material that could be used to form a spring having a slightly increasing long-term spring characteristic is chrome vanadium which is heat-set and which is used at an operating stress of 210,000 kPa (30,000 psi).

Where the chrome vanadium material described above is used for one of the springs 124, 130 and the low carbon steel material described above is used for the other of the springs 124, 130, the spring rate (e.g. Newtons per centimeter) of the low carbon steel spring should be three times the spring rate of the chrome vanadium spring.

Industrial Applicability

The control valve described above has numerous applications in fuel injection systems, including, for example, electronically-controlled injector fuel systems or mechanically actuated, electronically controlled injector fuel systems.

The control valve could be used to control various types of fuel injectors, including fuel injectors which incorporate check valves, such as fuel injectors of the type disclosed in U.S. Pat. No. 5,121,730 to Ausman, et al.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

We claim:

1. A fuel injector assembly for causing fuel to be injected during a fuel injection cycle having a start time and a stop time, said fuel injector assembly comprising:

a fuel injector nozzle;

a fuel pump;

a fuel inlet associated with said fuel pump, said fuel pump causing fuel to be periodically pumped from said fuel inlet through said fuel injector nozzle; and a control valve associated with said fuel pump for controlling said start time and said stop time of said fuel injection cycle, said control valve comprising:

a valve body;

an armature disposed in a recess in said valve body, said armature having a first side and an opposed second side and being reciprocable within said recess between a first position and a second position;

a first spring disposed on said first side of said armature to exert a first spring force on said armature, said first spring having a first long-term spring characteristic;

a second spring disposed on said second side of said armature to exert a second spring force on said armature, said second spring having a second long-term spring characteristic different than said first long-term spring characteristic so that said start time of said fuel injection cycle changes over time;

an electromagnetic device disposed adjacent one of said sides of said armature, said electromagnetic device causing said armature to occupy one of said first and second positions when said electromagnetic device is electrically energized; and a valve element rigidly connected to said armature and disposed for reciprocating movement within said valve body, said valve element allowing fluid flow through said control valve when said armature is in said first position and preventing fluid flow through said control valve when said armature is in said second position.

2. A fuel injector assembly as defined in claim 1 wherein said first spring is composed of a first material and wherein said second spring is composed of a second material different from said first material.

3. A fuel injector assembly as defined in claim 1 wherein said first and second long-term spring characteristics cause said start time to begin earlier.

4. A fuel injector assembly as defined in claim 1 wherein said first and second long-term spring characteristics cause said start time to begin later.

5. A fuel injector assembly as defined in claim 1 wherein one of said springs has a spring force and wherein said fuel injector assembly additionally comprises means for adjusting said spring force.

6. A fuel injector assembly as defined in claim 5 wherein said adjusting means comprises a trim screw operatively coupled to said one spring.

7. A fuel injector assembly as defined in claim 6 wherein said adjusting means additionally comprises a movable spring seat coupled between said one spring and said trim screw.

8. A fuel injector assembly as defined in claim 1 wherein said valve element comprises means for allowing fuel flow through said control valve when said armature is in said first position and preventing fuel flow through said control valve when said armature is in said second position.

9. A control valve adapted for a fuel injector having a fuel injection cycle with a start time and a stop time, said control valve comprising:

a valve body;

an armature disposed in a recess in said valve body, said armature having a first side and an opposed second side and being reciprocable within said recess;

a first spring disposed on said first side of said armature, said first spring having a first long-term spring characteristic;

a second spring disposed on said second side of said armature, said second spring having a second long-term spring characteristic different than said first long-term spring characteristic so that said start time of said fuel injection cycle changes over time;

an electromagnetic device disposed adjacent one of said sides of said armature, said electromagnetic device causing said armature to occupy a first position within said recess when said electromagnetic device is electrically energized; and a valve element rigidly connected to said armature and disposed for reciprocating movement within said valve body, said valve element allowing fluid flow through said control valve when said valve element is in an open position and preventing fluid flow through said control valve when said valve element is in a closed position.

10. A control valve as defined in claim 9 wherein said first spring is composed of a first material and wherein said second spring is composed of a second material different from said first material.

11. A control valve as defined in claim 9 wherein said first and second long-term spring characteristics cause said start time to begin earlier.

12. A control valve as defined in claim 9 wherein said first and second long-term spring characteristics cause said start time to begin later.

13. A control valve as defined in claim 8 wherein one of said springs has a spring force and wherein said control valve additionally comprises means for adjusting said spring force.

14. A control valve as defined in claim 13 wherein said adjusting means comprises a trim screw operatively coupled to said one spring.

15. A control valve as defined in claim 13 wherein said adjusting means additionally comprises a movable spring seat coupled between said one spring and said trim screw.

16. A control valve as defined in claim 9 wherein said valve element comprises means for allowing fuel flow through said control valve when said valve element is in said open position and preventing fuel flow through said control valve when said valve element is in said closed position.

* * * * *